US007106161B2

(12) United States Patent
Tozawa et al.

(10) Patent No.: US 7,106,161 B2
(45) Date of Patent: Sep. 12, 2006

(54) COIL COMPONENT

(75) Inventors: Yoji Tozawa, Tokyo (JP); Hidekazu Sato, Tokyo (JP); Kunihiko Kawasaki, Tokyo (JP); Yoshinori Mochizuki, Tokyo (JP); Satoru Okamoto, Tokyo (JP); Kouzou Sasaki, Tokyo (JP); Michiru Ishifune, Tokyo (JP); Shinichi Sato, Tokyo (JP); Katsumi Abe, Tokyo (JP); Shuumi Kumagai, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 11/149,190

(22) Filed: Jun. 10, 2005

(65) Prior Publication Data

US 2006/0006972 A1 Jan. 12, 2006

(30) Foreign Application Priority Data

Jul. 12, 2004 (JP) ..... 2004-205090

(51) Int. Cl.
*H01F 5/00* (2006.01)

(52) U.S. Cl. ..... 336/200; 336/192

(58) Field of Classification Search ..... 336/65, 336/83, 192, 200, 232
See application file for complete search history.

(56) References Cited

U.S. PATENT DOCUMENTS 5,302,932 A * 4/1994 Person et al. ..... 336/200
6,362,716 B1 * 3/2002 Anbo et al. ..... 336/200
6,452,473 B1 * 9/2002 Suzuki et al. ..... 336/223

FOREIGN PATENT DOCUMENTS

JP A 2002-305111 10/2002

* cited by examiner

*Primary Examiner*—Tuyen T Nguyen
(74) *Attorney, Agent, or Firm*—Oliff & Berridge, PLC

(57) ABSTRACT

A multilayer inductor is provided with a coil part including a coiled conductor and lead conductors, an outer sheath part covering the coil part and having an electrical isolation, and external electrodes electrically connected to the respective lead conductors. The lead conductors are located at both ends of the coiled conductor and have a width identical with that of the coiled conductor. The outer sheath part has two first side faces parallel to the axial direction of the coiled conductor and not adjacent to each other, and a second side face intersecting with the axial direction of the coiled conductor. Each external electrode has a first electrode portion formed throughout a direction perpendicular to the axial direction of the coiled conductor on the first side face. Each external electrode is not substantially formed on the second side face.

8 Claims, 16 Drawing Sheets

COIL COMPONENT

BACKGROUND OF THE INVENTION

1. Field of the Invention

The present invention relates to a coil component.

2. Related Background Art

An example of the known coil components of this type is the one as described in Japanese Patent Application Laid-Open No. 2002-305111 , which comprises a coil part including a coiled conductor, and lead conductors located at both ends of the coiled conductor, an outer sheath part covering the coil part, and a plurality of external electrodes electrically connected to the respective lead conductors.

The coil component described in Laid-Open No. 2002-305111 is a multilayer inductor. In this multilayer inductor, electrically insulating layers and conductor patterns are alternately stacked and ends of the respective conductor patterns are successively connected to form a coil (coiled conductor) superimposed in the stack direction in an electric insulator body (outer sheath part). The ends of the coil are connected through the lead conductors to the external electrodes at both ends of a chip. The external electrodes are formed only on a mounting surface parallel to the axial direction of the coil. An end of each lead conductors is exposed in the mounting surface and in a chip side face, and the exposed conductor in the chip side face is connected through a beltlike (ribbonlike) electrode to the associated external electrode. When viewed from the axial direction of the coil, the width of the lead conductors is wider than the width of the coiled conductor.

SUMMARY OF THE INVENTION

However, the coil component described in Laid-Open No. 2002-305111 has problems as described below.

Normally, the coil component of the configuration as described above is mounted as electrically and mechanically connected to a circuit board by soldering the external electrodes to electrode pads formed on the circuit board. In the case of the coil component described in Laid-Open No. 2002-305111, the external electrodes formed on the mounting surface, and beltlike electrodes are soldered, but the soldering area is narrow because each electrode is narrow in width and small. For this reason, there is a risk of failure in securing the mounting strength of the coil component.

In the coil component described in Laid-Open No. 2002-305111, when viewed from the axial direction of the coil, the width of the lead conductors is wider than the width of the coiled conductor. For this reason, the wide lead conductors inhibit the flux (magnetic flux) generated in the coiled conductor to degrade Q (quality factor) which is an important property of the coil component.

Incidentally, the external electrodes are also a factor to inhibit the flux generated in the coiled conductor to degrade Q. The degree of the external electrodes' inhibiting the flux is largely dependent on the positions where the external electrodes are formed (on the side face of the outer sheath part). Particularly, if the external electrodes are located at the position where the axis of the coiled conductor intersects, they will heavily inhibit the flux to considerably degrade Q.

An object of the present invention is to provide a coil component capable of suppressing the degradation of Q, while maintaining the mounting strength.

A coil component according to the present invention is a coil component comprising: a coil part including a coiled conductor, and lead conductors located at both ends of the coiled conductor and having a width identical to a width of the coiled conductor; an outer sheath part covering the coil part and having an electrical isolation; and a plurality of external electrodes electrically connected to the respective lead conductors, wherein the outer sheath part has two first side faces which are parallel to an axial direction of the coiled conductor and which are not adjacent to each other, and a second side face intersecting with the axial direction of the coiled conductor, and wherein each of the external electrodes has an electrode portion formed throughout a direction perpendicular to the axial direction of the coiled conductor on the first side face and is not substantially formed on the second side face.

In the coil component according to the present invention, each external electrode electrically connected to the lead conductor has the electrode portion formed throughout the direction perpendicular to the axial direction of the coiled conductor on the first side face, whereby it is easier to secure the soldering area than in the coil component described in Laid-Open No. 2002-305111. The outer sheath part will be mechanically connected to a circuit board through the external electrodes throughout the direction perpendicular to the axial direction of the coiled conductor on the first side faces. In consequence of these, it is feasible to secure the mounting strength of the coil component.

Since the lead conductors have the same width as the coiled conductor, the present invention prevents the lead conductors from inhibiting the flux generated in the coiled conductor, and suppresses the degradation of Q. Since the external electrodes are not substantially formed on the second side face intersecting with the axial direction of the coiled conductor, the flux is not heavily inhibited by the external electrodes.

Preferably, the outer sheath part further has a third side face parallel to the axial direction of the coiled conductor and adjacent to each first side face, and each of the external electrodes further has an electrode portion which is formed on a part of the third side face and which is electrically continuous to the electrode portion formed on the first side face. In this case, it becomes much easier to secure the soldering area. The first side faces and the third side face will be mechanically connected through the external electrodes to a circuit board. In consequence of these, it is feasible to secure sufficient mounting strength of the coil component.

Preferably, the outer sheath part further has a fourth side face which is parallel to the axial direction of the coiled conductor and adjacent to each first side face and which is located so as to face the third side face with the coil part in between, and each of the external electrodes further has an electrode portion which is formed on a part of the fourth side face and which is electrically continuous to the electrode portion formed on the first side face. In this case, it becomes much easier to secure the soldering area. In addition, the first side faces, the third side face, and the fourth side face will be mechanically connected through the external electrodes to a circuit board. In consequence of these, it is feasible to secure significantly sufficient mounting strength of the coil component.

Preferably, each of the lead conductors extends toward the first side face and is connected to the electrode portion formed on the first side face, thereby being electrically connected to the corresponding external electrode.

Preferably, the outer sheath part further has third and fourth side faces which are parallel to the axial direction of the coiled conductor and adjacent to each first side face and which are located so as to face each other with the coil part in between; where the third side face is defined as a mounting surface, when viewed from the axial direction of the coiled conductor, a spacing between each lead conductor and the fourth side face is set smaller than a spacing between each lead conductor and the third side face. In this case, it is feasible to further suppress the degradation of Q.

Preferably, each of the lead conductors extends toward the third side face and is connected to the electrode portion formed on the third side face, thereby being electrically connected to the corresponding external electrode.

Preferably, the outer sheath part includes a plurality of stacked insulators, and the coiled conductor and the lead conductors are comprised of conductor patterns formed on the respective insulators. In this case, a multilayer coil component is substantialized. Since each external electrode has the electrode portion formed throughout the direction perpendicular to the axial direction of the coiled conductor on the first side face, the electrode portion is formed over the plurality of insulators. This results in preventing peeling of the insulators or the like and enhancing the strength of the coil component itself.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The preferred embodiments of the present invention will be described below in detail with reference to the accompanying drawings. The same elements, or elements with the same function will be denoted by the same reference symbols in the description, without redundant description. The embodiments are application of the present invention to multilayer inductors.

First Embodiment

Figure 1:
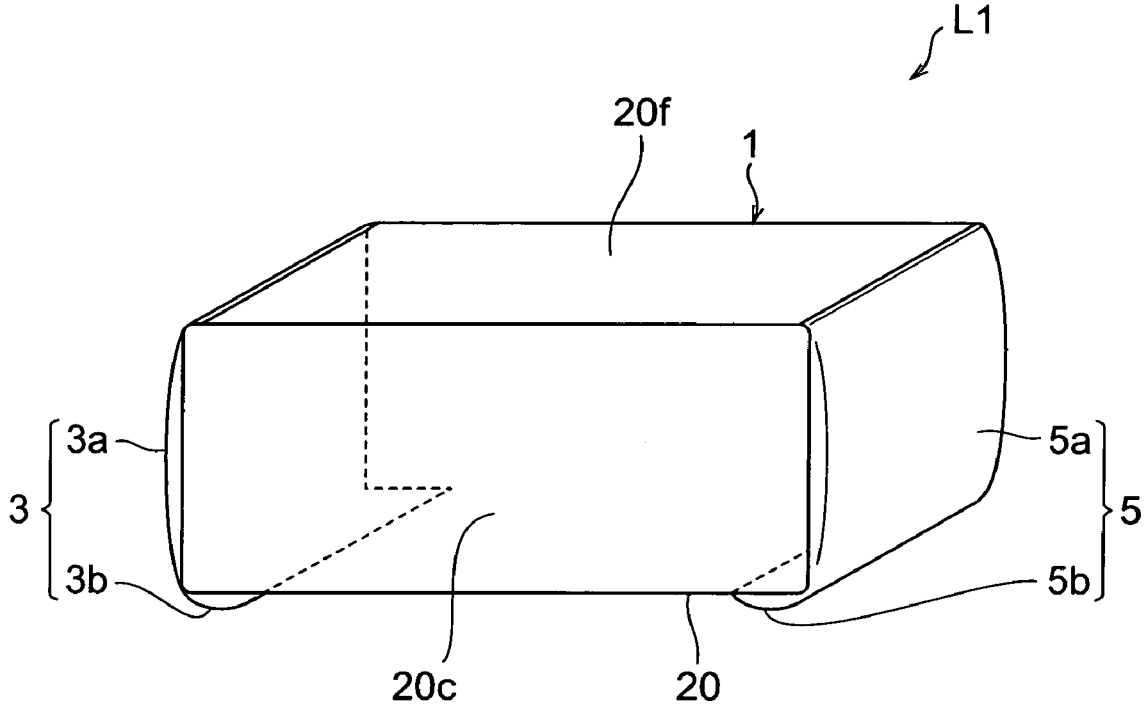
FIG. 1 is a perspective view illustrating a multilayer inductor according to the first embodiment.
Figure 2:
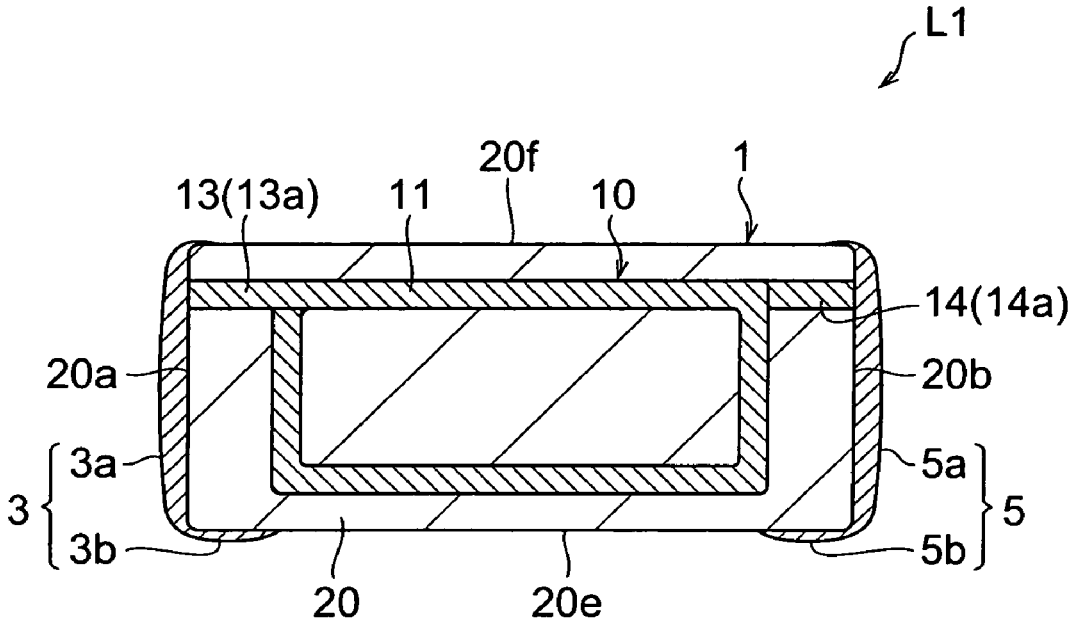
FIG. 2 is a view for explaining a sectional configuration of the multilayer inductor according to the first embodiment.
Figure 3:
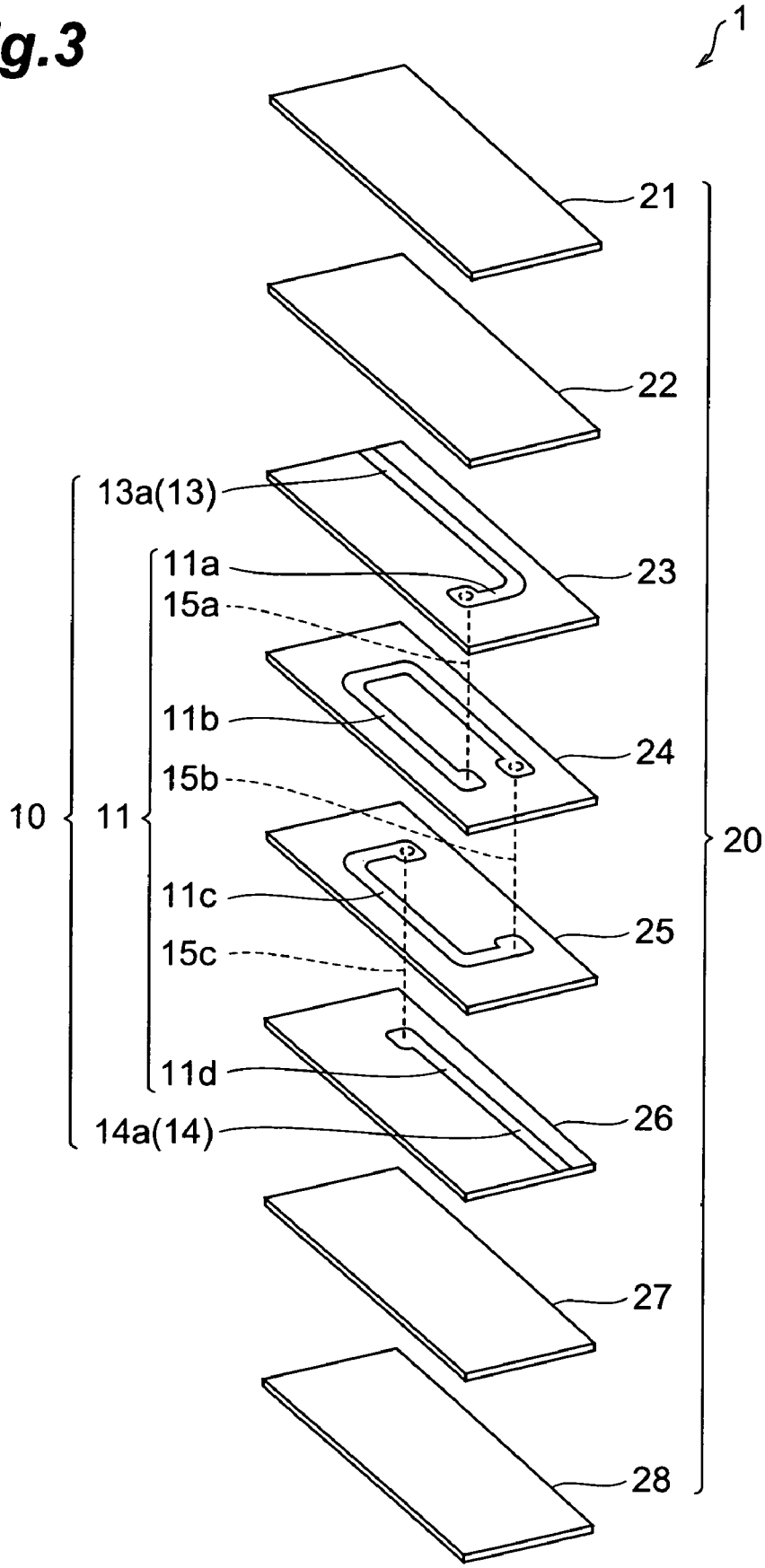
FIG. 3 is an exploded perspective view illustrating elements included in the multilayer inductor according to the first embodiment.
Figure 4:
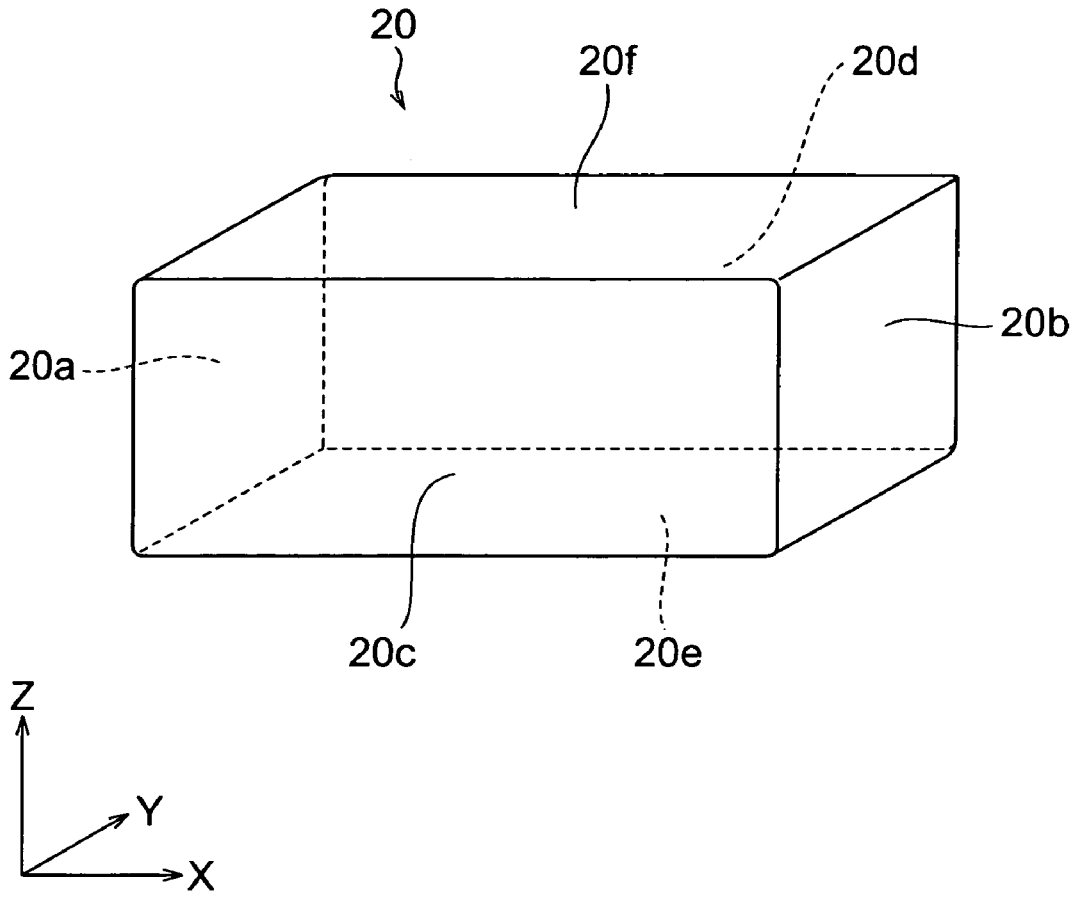
FIG. 4 is a perspective view illustrating an outer sheath part included in the multilayer inductor according to the first embodiment.

First, a configuration of a multilayer inductor L1 according to the first embodiment will be described on the basis of FIGS. 1 to 3. FIG. 1 is a perspective view illustrating the multilayer inductor of the first embodiment. FIG. 2 is a view for explaining the sectional configuration of the multilayer inductor of the first embodiment. FIG. 3 is an exploded perspective view illustrating elements included in the multilayer inductor of the first embodiment. FIG. 4 is a perspective view illustrating an outer sheath part included in the multilayer inductor of the first embodiment.

The multilayer inductor L1, as shown in FIG. 1, is provided with an element 1 of rectangular parallelepiped shape, and a pair of terminal electrodes (external electrodes) 3, 5. The element 1, as shown in FIG. 2, has a coil part 10 and an outer sheath part 20. The coil part 10, as shown in FIG. 3, includes a coiled conductor 11, and lead conductors 13, 14 located at both ends of the coiled conductor 11. The outer sheath part 20 includes a plurality of (eight layers in the present embodiment) stacked insulators 21 to 28. In practical multilayer inductor L1, the plurality of insulators 21–28 are integrated in such a manner that the borders between the insulators 21–28 cannot be visually recognized. The insulators 21–28 are made by baking nonmagnetic green sheets.

The outer sheath part 20 (element 1), as also shown in FIG. 4, has two first side faces 20*a*, 20*b*, two second side faces 20*c*, 20*d*, third side face 20*e*, and fourth side face 20*f*. The first side faces 20*a*, 20*b* are located so as to face each other when viewed from the direction of the X-axis. The second side faces 20*c*, 20*d* are located so as to face each other when viewed from the direction of the Y-axis. The third side face 20*e* and the fourth side face 20*f* are located so as to face each other when viewed from the direction of the Z-axis. Therefore, the first side faces 20*a*, 20*b* are not adjacent to each other, and the second side faces 20*c*, 20*d* are not adjacent to each other, either. The third side face 20*e* and the fourth side face 20*f* are not adjacent to each other, either. The first side faces 20*a*, 20*b* and the third side face 20*e* are adjacent to each other, and the first side faces 20*a*, 20*b* and the fourth side face 20*f* are also adjacent to each other.

The first side faces 20*a*, 20*b*, the third side face 20*e*, and the fourth side face 20*f* are parallel to the axial direction of the coiled conductor 11. The second side faces 20*c*, 20*d* intersect with the axial direction of the coiled conductor 11. In the present embodiment, the second side faces 20*c*, 20*d* are perpendicular to the axial direction of the coiled conductor 11. When the multilayer inductor L1 is mounted on a circuit board (not shown), the third side face 20*e* is a surface (mounting surface) facing the circuit board.

Each terminal electrode 3, 5 includes a first electrode portion 3*a*, 5*a* and a second electrode portion 3*b*, 5*b* electrically continuous to each other. Each of the first electrode portions 3*a*, 5*a* is formed throughout the direction perpendicular to the axial direction of the coiled conductor 11 on the first side face 20*a*, 20*b*. Each of the first electrode portions 3*a*, 5*a* is also formed throughout the axial direction of the coiled conductor 11 on the first side face 20*a*, 20*b*. In this configuration the first electrode portion 3*a*, 5*a* in the present embodiment is formed so as to cover the entire surface of the first side face 20*a*, 20*b*.

The second electrode portions 3*b*, 5*b* are formed on a part of the third side face 20*e*. Specifically, each of the second electrode portions 3*b*, 5*b* is formed along a ridge to the first side face 20*a*, 20*b* on the third side face 20*e*. The second electrode portions 3*b*, 5*b* have a predetermined spacing to each other and are electrically isolated from each other.

Each terminal electrode 3, 5 is not substantially formed on the second side faces 20*c*, 20*d*. In the element 1, each apex and each ridge are formed as curved. For this reason, where the first electrode portion 3*a*, 5*a* is formed on the entire surface of the first side face 20*a*, 20*b*, the first electrode portion 3*a*, 5*a* is formed round over the corner by at most about 100 μm on the second side face 20*c*, 20*d*. Therefore, the term "substantially" is intended for inclusion of the electrode portions inevitably formed on the second side faces 20*c*, 20*d* in formation of each terminal electrode 3, 5 (the first electrode portions 3*a*, 5*a* and others).

The coiled conductor 11 is comprised of conductor patterns 11*a*–11*d* formed on the insulators 23–26. The lead conductors 13, 14 are comprised of conductor patterns 13*a*, 14*a* formed on the insulators 23, 26. In the present embodiment, the conductor pattern 11*a* and the conductor pattern 13*a* are integrally and continuously formed, and the conductor pattern 11*d* and the conductor pattern 14*a* are integrally and continuously formed.

The conductor pattern 11*a* is equivalent to approximately a half turn of the coiled conductor 11 and extends in a nearly L-shape on the insulator 23. The conductor pattern 11*b* is equivalent to approximately three quarters of a turn of the coiled conductor 11, and extends in a nearly U-shape on the insulator 24. The conductor pattern 11*c* is equivalent to approximately three quarters of a turn of the coiled conductor 11, and extends in a nearly C-shape on the insulator 25. The conductor pattern 11*d* is equivalent to approximately a quarter turn of the coiled conductor 11, and extends in a nearly I-shape on the insulator 26. The ends of the conductor patterns 11*a*–11*d* are electrically connected by through hole electrodes 15*a*–15*c* formed in the respective insulators 23–25. The conductor patterns 11*a*–11*d* are electrically connected to each other, thereby constituting the coiled conductor 11.

The conductor pattern 13*a* extends in a nearly I-shape continuously from one end of the conductor pattern 11*a* on the insulator 23. One end of the conductor pattern 13*a* is led out to the edge part of the insulator 23 to be exposed in the end face of the insulator 23. The conductor pattern 13*a* is led out up to the first side face 20*a* of element 1 to be electrically connected to one terminal electrode 3. The conductor pattern 13*a* (lead conductor 13) has the same width as the conductor pattern 11*a* (coiled conductor 11), when viewed from the axial direction of the coiled conductor 11.

The conductor pattern 14*a* extends in a nearly I-shape continuously from the other end of the conductor pattern 11*d* on the insulator 26. The other end of the conductor pattern 14*a* is led out to the edge part of the insulator 26 to be exposed in the end face of the insulator 26. The conductor pattern 14*a* is led out up to the first side face 20*b* of element 1 to be electrically connected to the other terminal electrode 5. The conductor pattern 14*a* (lead conductor 14) has the same width as the conductor pattern 11*d* (coiled conductor 11), when viewed from the axial direction of the coiled conductor 11.

Each lead conductor 13, 14, as also shown in FIG. 2, extends toward the first side face 20*a*, 20*b* and is connected to the first electrode portion 3*a*, 5*a* formed on the first side face 20*a*, 20*b*, thereby being electrically connected to the corresponding terminal electrode 3, 5. When viewed from the axial direction of the coiled conductor 11, the spacing between each lead conductor 13, 14 and the fourth side face 20*f* is set smaller than the spacing between each lead conductor 13, 14 and the third side face 20*e* (mounting surface). Namely, each lead conductor 13, 14 is located apart from the third side face 20*e*, when viewed from the axial direction of the coiled conductor 11.

The conductor patterns 13*a*, 14*a* (lead conductors 13, 14) do not have to have the same width as the conductor patterns 11*a*, 11*d* (coiled conductor 11), throughout the direction in which the conductor patterns 13*a*, 14*a* extend. They may be formed a little wider near the edge part of the insulator 23, 26, i.e., near the first electrode portion 3*a*, 5*a*. When the conductor patterns 13*a*, 14*a* are arranged a little wider near the first electrode portions 3*a*, 5*a* in this manner, reliability is improved in connection to the first electrode portions 3*a*, 5*a*.

The nonmagnetic green sheets for making the insulators 21–28 are glass ceramic green sheets having the electrical isolation. The composition of the nonmagnetic green sheets is, for example, glass 70 wt % comprising strontium, calcium, and silicon oxide, and alumina powder 30 wt %. The thickness of the nonmagnetic green sheets is, for example, about 30 μm. The nonmagnetic green sheets can be replaced, for example, by magnetic green sheets formed by applying a slurry containing a source material of powder of a ferrite (e.g., Ni—Cu—Zn base ferrite, Ni—Cu—Zn—Mg base ferrite, Cu—Zn base ferrite, or Ni—Cu base ferrite), onto film by the doctor blade method.

Subsequently, a production method of the multilayer inductor L1 of the above-described configuration will be described.

First, nonmagnetic green sheets for making the insulators 21–28 are prepared. The nonmagnetic green sheets for making the insulators 21–28 are glass ceramic green sheets having the electric insulation property. The composition of the nonmagnetic green sheets is, for example, glass 70 wt % comprising strontium, calcium, and silicon oxide, and alumina powder 30 wt %. The nonmagnetic green sheets can be, for example, those formed by applying a slurry comprising the above materials as source materials, onto film by the doctor blade method. The thickness of the nonmagnetic green sheets is, for example, about 30 μm.

Next, through holes are formed by laser processing or the like, at predetermined positions of the respective nonmagnetic green sheets for making the insulators 23–25, i.e., at intended positions for formation of the through hole electrodes 15*a*–15*c*.

Next, plural sets of electrode portions corresponding to the conductor pattern 11*a*–11*d*, lead conductor 13, 14, and through hole electrode 15*a*–15*c* (in a number corresponding to the number of segment chips described hereinafter) are formed on each of the nonmagnetic green sheets for making the insulators 23–26. The electrode portions corresponding to the conductor patterns 11*a*–11*d* and lead conductors 13, 14 are formed, for example, by screen-printing a electrically conductive paste comprising silver as the main component onto each green sheet and drying it. No electrode portion is formed on each of the nonmagnetic green sheets for making the insulators 21, 22, 27, and 28. Each through hole is filled with the electrically conductive paste in the work of forming the electrode portions corresponding to the conductor patterns 11*a*–11*c* and lead conductors 13. The electrode portions corresponding to the through hole electrodes 15*a*–15*c* are formed by the electrically conductive paste filled in each through hole.

Next, the nonmagnetic green sheets for making the insulators 21–28 are successively stacked, pressed, and cut into chip units, followed by firing at a predetermined temperature (e.g., 800–900° C.). This results in obtaining the element 1. The element 1 is sized, for example, in the longitudinal length of 0.6 mm, the width of 0.3 mm, and the height of 0.3 mm after fired. The width of the conductor patterns 11*a*–11*d* and lead conductors 13, 14 after fired is set, for example, to about 40 μm. The thickness of the conductor patterns 11*a*–11*d* and lead conductors 13, 14 after fired is set, for example, to about 12 μm. The inner size of the coiled conductor 11 is set, for example, so that the length in the direction of the major axis is approximately 320 μm and the length in the direction of the minor axis approximately 120 μm.

Next, the terminal electrodes 3, 5 are formed on the element 1. This results in forming the multilayer inductor L1. The terminal electrodes 3, 5 are formed by transferring an electrode paste comprising silver as the main component onto the outer surface of the element 1 obtained as described above, thereafter baking it at a predetermined temperature (e.g., about 700° C.), and further effecting electroplating thereon. The electroplating can be performed, for example, with Cu, Ni, and Sn, with Ni and Sn, with Ni and Au, with Ni, Pd, and Au, with Ni, Pd, and Ag, or with Ni and Ag.

In the present first embodiment, as described above, each terminal electrode 3, 5, to which the lead conductor 13, 14 (conductor pattern 13*a*, 14*a*) is electrically connected, has the first electrode portion 3*a*, 5*a* formed throughout the direction perpendicular to the axial direction of the coiled conductor 11 on the first side face 20*a*, 20*b*, and it is thus easier to secure the soldering area than in the coil component described in Laid-Open No. 2002-305111. The outer sheath part 20 is mechanically connected to a circuit board via the terminal electrodes 3, 5 throughout the direction perpendicular to the axial direction of the coiled conductor 11 on the first side faces 20*a*, 20*b*. In consequence of these, it is feasible to secure the mounting strength of the multilayer inductor L1.

In the present embodiment, the lead conductors 13, 14 (conductor patterns 13*a*, 14*a*) have the same width as the coiled conductor 11 (conductor patterns 11*a*, 1*d*), whereby it is feasible to prevent the lead conductors 13, 14 from inhibiting the flux generated in the coiled conductor 11 and to suppress the degradation of Q in the multilayer inductor L1. Since the terminal electrodes 3, 5 are not substantially formed on the second side faces 20*c*, 20*d* intersecting with the axial direction of the coiled conductor 11, the flux is prevented from being significantly inhibited by the terminal electrodes 3, 5.

In the present embodiment, the outer sheath part 20 has the third side face 20*e* parallel to the axial direction of the coiled conductor 11 and adjacent to each first side face 20*a*, 20*b*, and each terminal electrode 3, 5 further has the second electrode portion 3*b*, 5*b* formed on a part of the third side face 20*e* and being electrically continuous to the first electrode portion 3*a*, 5*a* formed on the first side face 20*a*, 20*b*. This makes it much easier to secure the soldering area. The first side faces 20*a*, 20*b* and the third side face 20*e* will also be mechanically connected through the terminal electrodes 3, 5 to a circuit board. In consequence of these, it is feasible to secure sufficient mounting strength of the multilayer inductor L1.

In the present embodiment, the outer sheath part 20 has the fourth side face 20*f* being parallel to the axial direction of the coiled conductor 11 and adjacent to each first side face 20*a*, 20*b* and located so as to face the third side face 20*e*, and, where the third side face 20*e* is defined as a mounting surface, when viewed from the axial direction of the coiled conductor 11, the spacing between each lead conductor 13, 14 and the fourth side face 20*f* is set smaller than the spacing between each lead conductor 13, 14 and the third side face 20*e*. This makes it feasible to further suppress the degradation of Q in the multilayer inductor L1.

Figure 5:
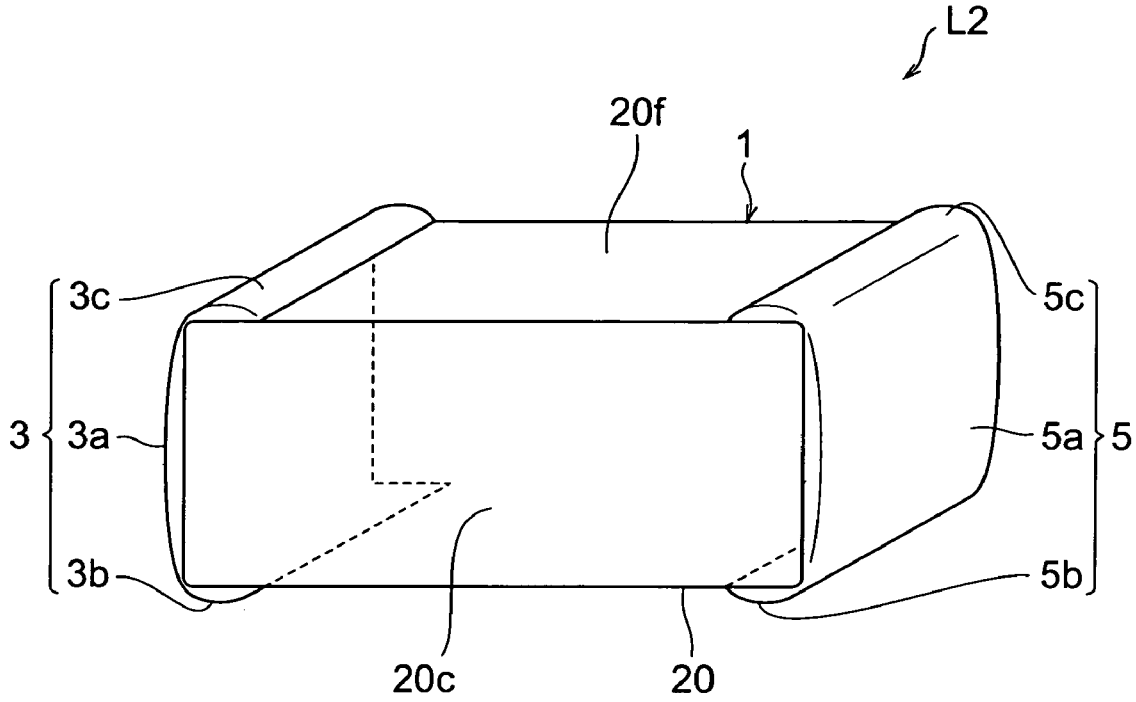
FIG. 5 is a perspective view illustrating a multilayer inductor according to the second embodiment.
Figure 6:
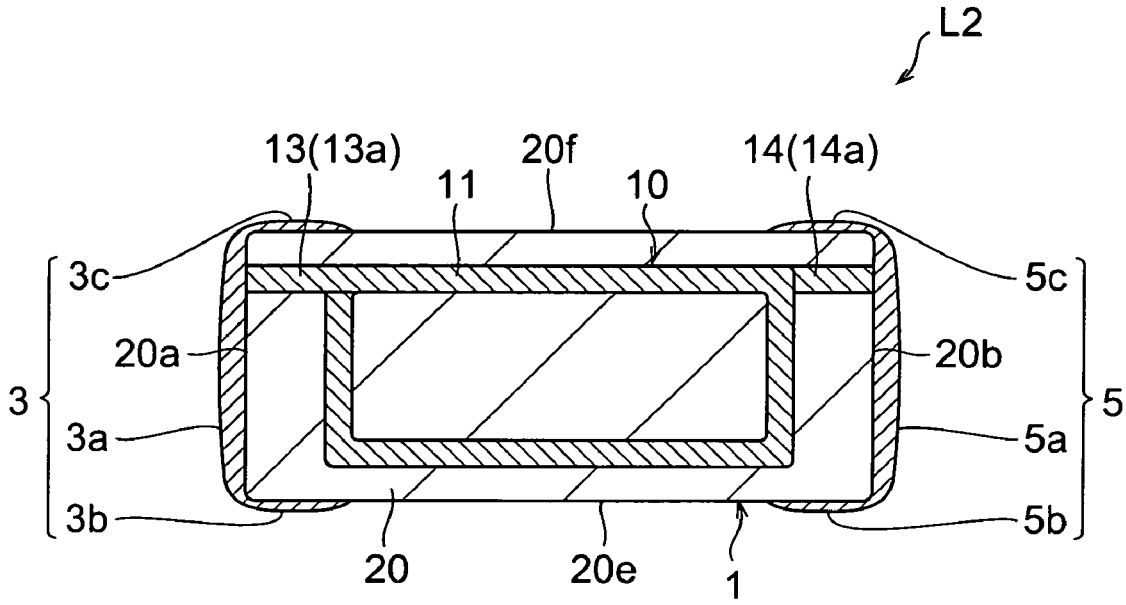
FIG. 6 is a view for explaining a sectional configuration of the multilayer inductor according to the second embodiment.

In the present embodiment, the outer sheath part 20 includes a plurality of stacked insulators 21–28, and the coiled conductor 11 and lead conductors 13, 14 are comprised of the conductor patterns 11*a*–11*d*, 13*a*, and 14*a* formed on the insulators 23–26. In this case, the multilayer inductor L1 is substantialized as a coil component. Since each terminal electrode 3, 5 has the first electrode portion 3*a*, 5*a* formed throughout the direction perpendicular to the axial direction of the coiled conductor 11 on the first side face 20*a*, 20*b*, the first electrode portion 3*a*, 5*a* is formed over the plurality of insulators 21–28. In consequence of this, it is feasible to prevent peeling of the insulators 21–28 or the like, thereby improving the strength of the multilayer inductor L1 itself Second Embodiment First, a configuration of a multilayer inductor L2 according to the second embodiment will be described based on FIGS. 5 and 6. FIG. 5 is a perspective view illustrating the multilayer inductor of the second embodiment. FIG. 6 is a diagram for explaining a sectional configuration of the multilayer inductor of the second embodiment. The multilayer inductor L2 of the second embodiment is different in the configuration of the terminal electrodes 3, 5 from the multilayer inductor L1 of the first embodiment.

The multilayer inductor L2, as shown in FIG. 5, is provided with an element 1 and a pair of terminal electrodes 3, 5. The element 1, as shown in FIG. 6, has a coil part 10 and an outer sheath part 20.

Each terminal electrode 3, 5 includes a first electrode portion 3*a*, 5*a*, a second electrode portion 3*b*, 5*b*, and a third electrode portion 3*c*, 5*c* which are electrically continuous to each other. The third electrode portion 3*c*, 5*c* is formed on a part of the fourth side face 20*f* . Specifically, each of the third electrode portions 3*c*, 5*c* is formed along a ridge to the first side face 20*a*, 20*b* on the fourth side face 20*f*. The third electrode portions 3*c*, 5*c* are formed with a predetermined spacing to each other and are electrically isolated from each other. In the multilayer inductor L2, each terminal electrode 3, 5 is not substantially formed on the second side faces 20*c*, 20*d*, either.

In the present second embodiment, as described above, the outer sheath part 20 further has the fourth side face 20*f* being parallel to the axial direction of the coiled conductor 11 and adjacent to each first side face 20*a*, 20*b* and located so as to face the third side face 20*e* with the coil part 10 in between. Since each terminal electrode 3, 5 further has the third electrode portion 3*c*, 5*c* formed on a part of the fourth side face 20*f* and being electrically continuous to the first electrode portion 3*a*, 5*a*, it becomes much easier to secure the soldering area than in the coil component described in Laid-Open No. 2002-305111. In addition, the first side faces 20*a*, 20*b*, the third side face 20*e*, and the fourth side face 20*f* will also be mechanically connected through the terminal electrodes 3, 5 to a circuit board. In consequence of these, it is feasible to secure significantly satisfactory mounting strength of the multilayer inductor L2.

In the present second embodiment, just as in the first embodiment, it is feasible to prevent the lead conductors 13, 14 from inhibiting the flux generated in the coiled conductor 11 and to suppress the degradation of Q in the multilayer inductor L1.

Figure 8:
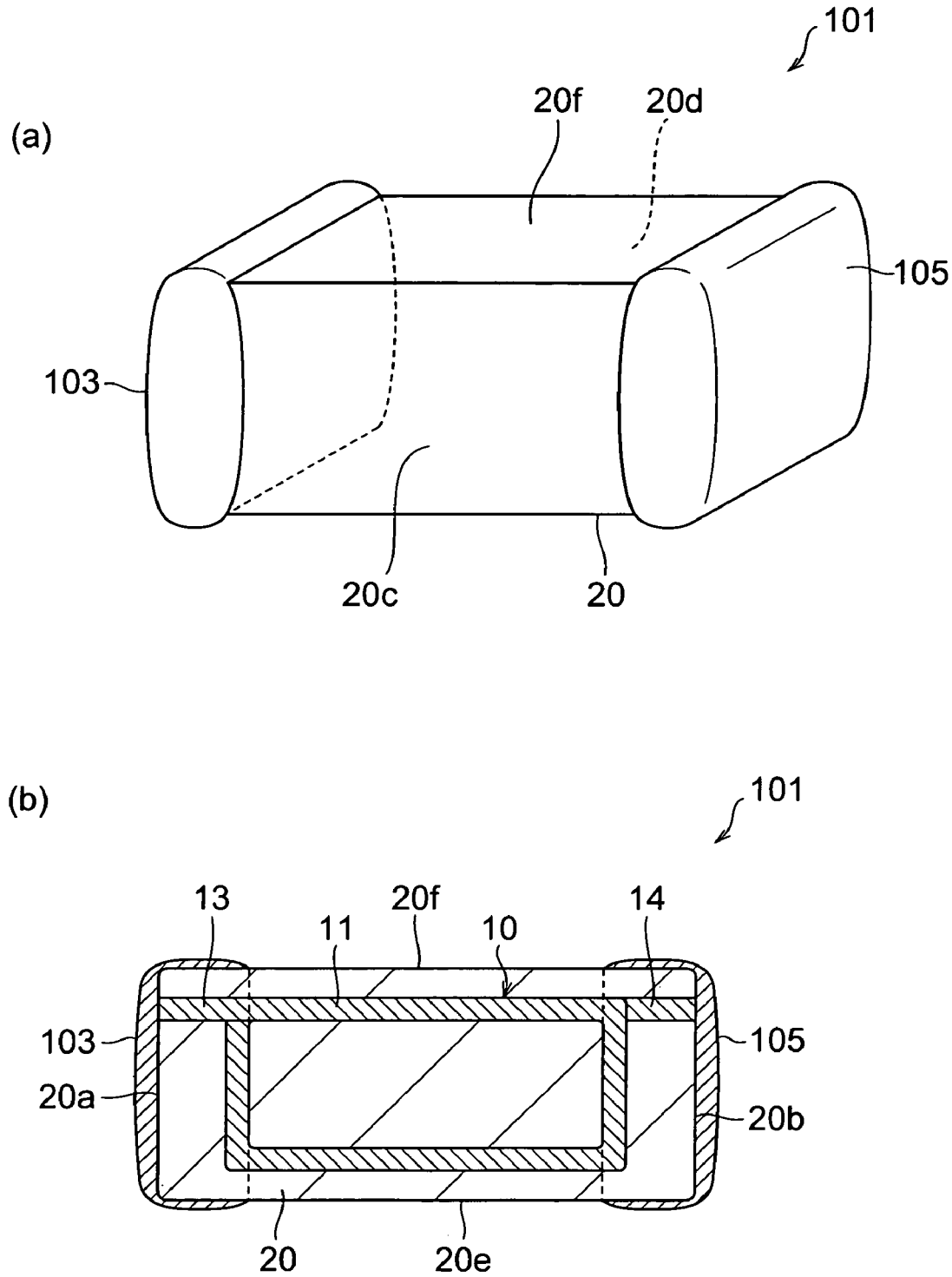
FIG. 8 is a view illustrating a multilayer inductor as a comparative example.

An explanation will be given here on the results of measurement of frequency characteristics of Q in the multilayer inductors L1, L2 of the first and second embodiments. A multilayer inductor 101 in which the terminal electrodes 103, 105 were formed on a part of the second side faces 20*c*, 20*d* intersecting with the axial direction of the coiled conductor 11, as shown in FIG. 8, was used as a comparative example for indicating usefulness of the multilayer inductors L1, L2 of the first and second embodiments. The multilayer inductor 101 of the comparative example had the same configuration as the aforementioned multilayer inductors L1, L2, except for the configuration of the terminal electrodes 103, 105. Each multilayer inductor L1, L2, or 101 was designed to have the inductance of 1.8 nH.

Figure 7:
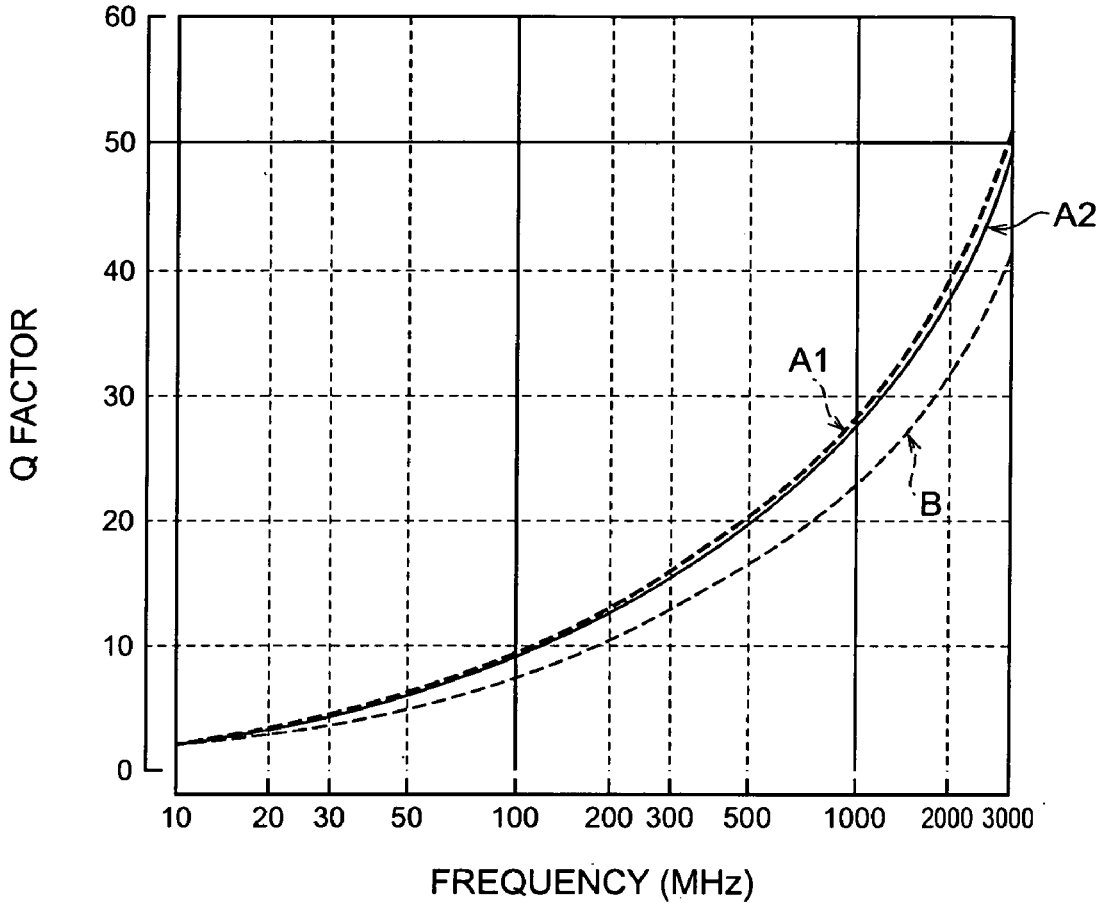
FIG. 7 is a diagram illustrating frequency characteristics of Q.

The measurement results are represented in FIG. 7. A characteristic A1 indicates the frequency characteristic of Q of the multilayer inductor L1 according to the first embodiment, and a characteristic A2 the frequency characteristic of Q of the multilayer inductor L2 according to the second embodiment. A characteristic B indicates the frequency characteristic of Q of the multilayer inductor 101 according to the comparative example. As shown in FIG. 7, the multilayer inductors L1, L2 of the first and second embodiments demonstrate Q larger than that of the multilayer inductor 101 of the comparative example. This confirmed the effect of suppressing the decrease of Q by the first and second embodiments.

The present invention is by no means limited to the above embodiments. For example, each terminal electrode 3, 5 does not have to be limited to the configurations described in the first and second embodiments above. For example, each terminal electrode 3, 5 may have only the first electrode portion 3*a*, 5*a*. The shape of the outer sheath part 20 is not limited to the rectangular parallelepiped shape, either.

Figure 9:
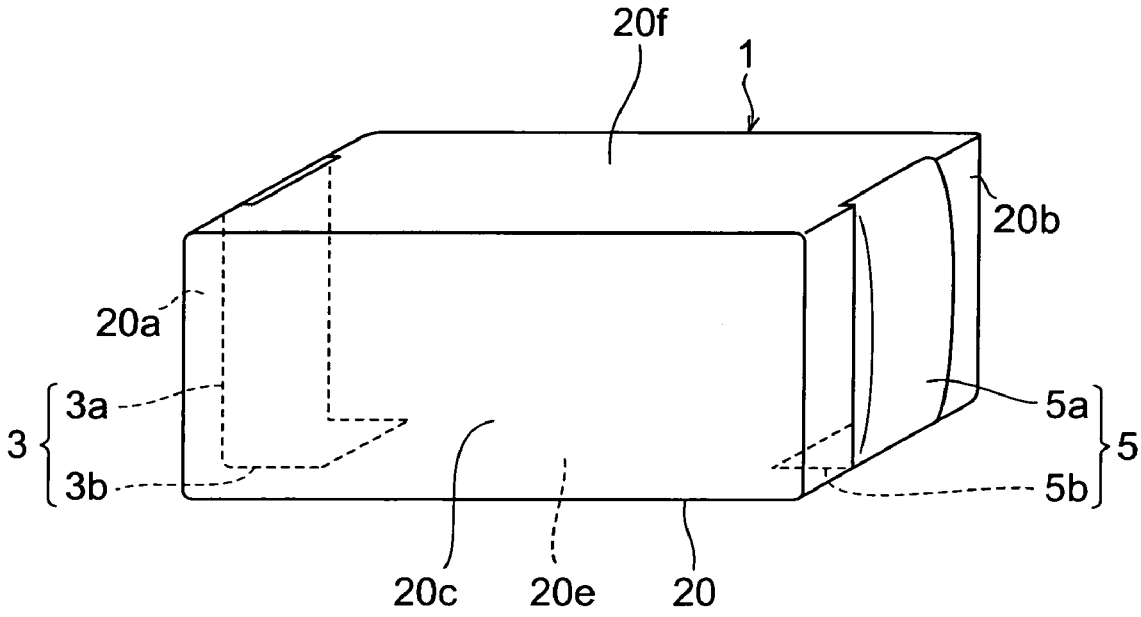
FIG. 9 is a view for explaining a sectional configuration of a modification example of the multilayer inductors according to the first and second embodiments.
Figure 10:
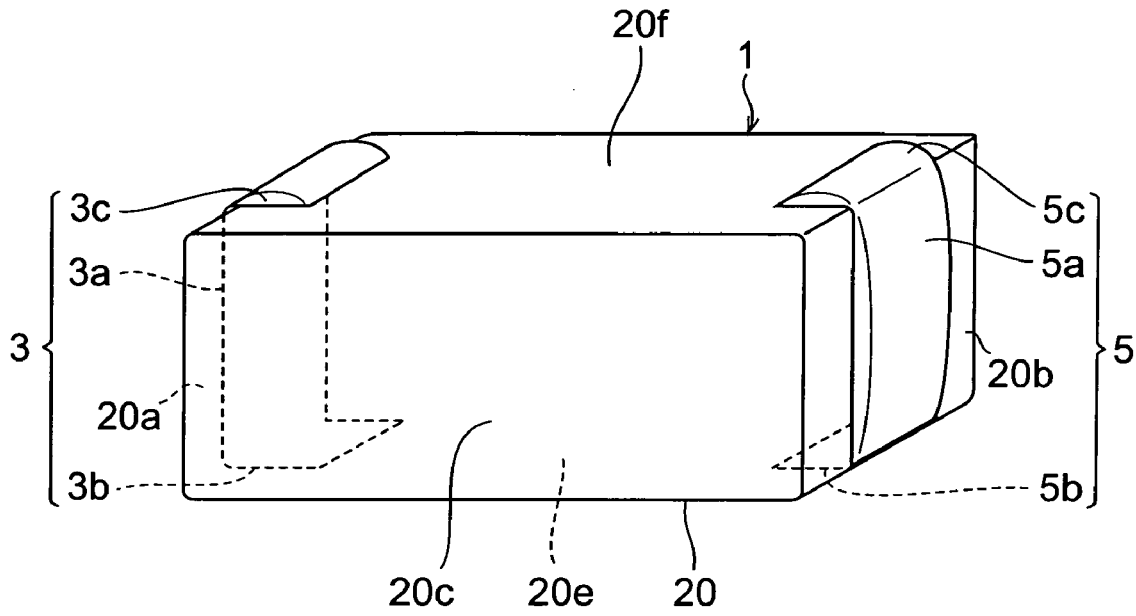
FIGS. 10 to 16 are views for explaining sectional configurations of modification examples of the multilayer inductors according to the first and second embodiments.

Each electrode portion 3*a*–3*c*, 5*a*–5*c* is formed throughout the axial direction of the coiled conductor 11 on each corresponding side face 20*a*, 20*b*, 20*e*, 20*f*, but does not have to be limited to this. As shown in FIGS. 9 and 10, each electrode portion 3*a*–3*c*, 5*a*–5*c* may be formed so as to be spaced from the edges in the axial direction of the coiled conductor 11 on each side face 20*a*, 20*b*, 20*e*, 20*f*, without passing throughout the axial direction of the coiled conductor 11 on each corresponding side face 20*a*, 20*b*, 20*e*, 20*f*.

Figure 11:
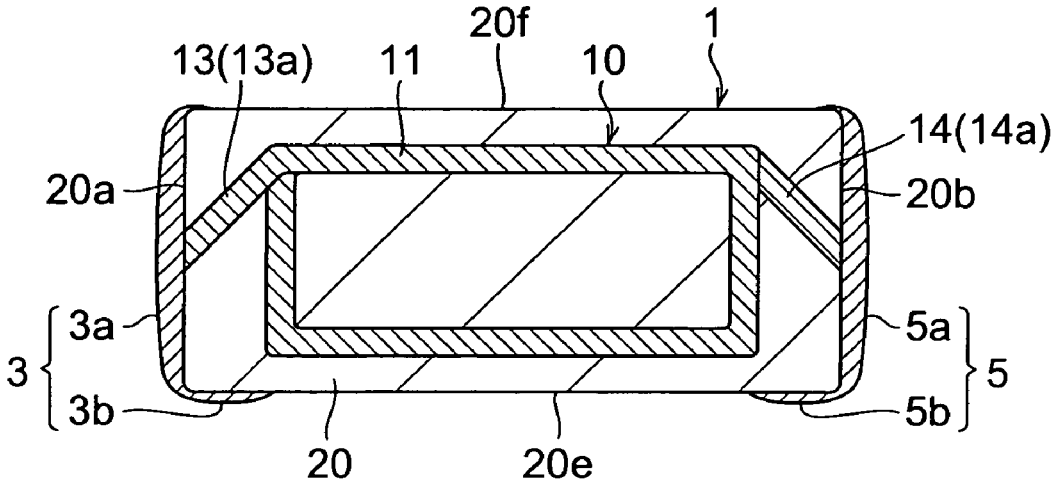
Figure 12:
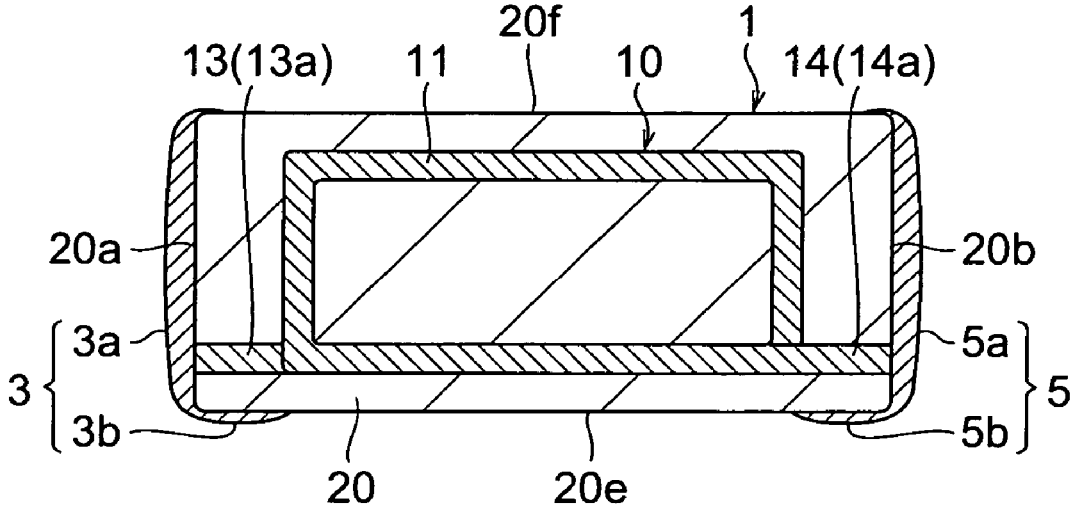
Figure 13:
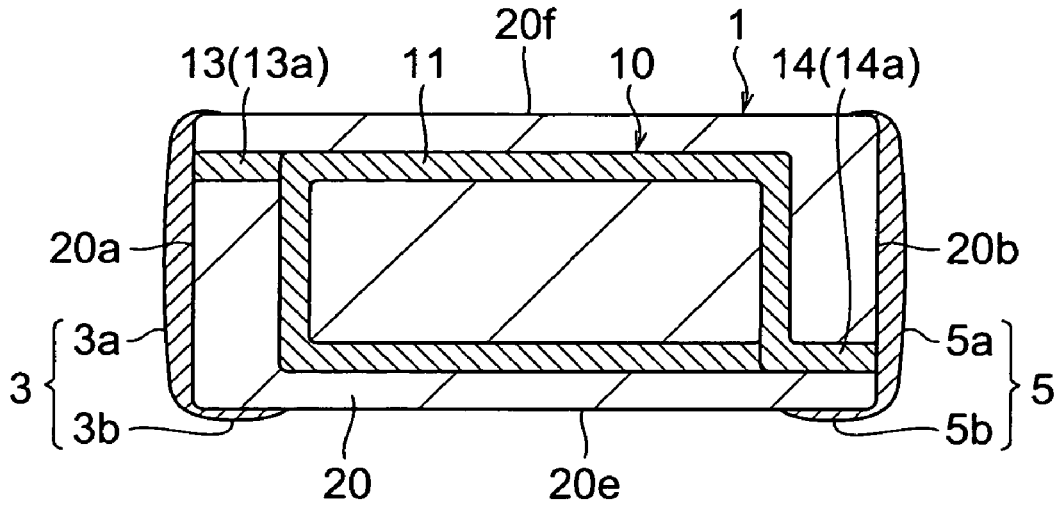

The connection position between each lead conductor 13, 14 (conductor pattern 13*a*, 14*a*) and terminal electrode 3, 5 is not limited to the position in the first electrode portion 3*a*, 5*a* near the fourth side face 20*f*, as shown in FIG. 2. The connection position between each lead conductor 13, 14 (conductor pattern 13*a*, 14*a*) and terminal electrode 3, 5 may be an intermediate position between the fourth side face 20*f* and the third side face 20*e* in the first electrode portion 3*a*, 5*a*, or a position in the first electrode portion 3*a*, 5*a* near the third side face 20*e*, as shown in FIGS. 11 and 12. In another configuration, as shown in FIG. 13, the connection position of either one of the lead conductors 13, 14 is defined at a position near the fourth side face 20*f*, and the connection position of the other of the lead conductors 13, 14 at a position near the third side face 20*e*.

Figure 14:
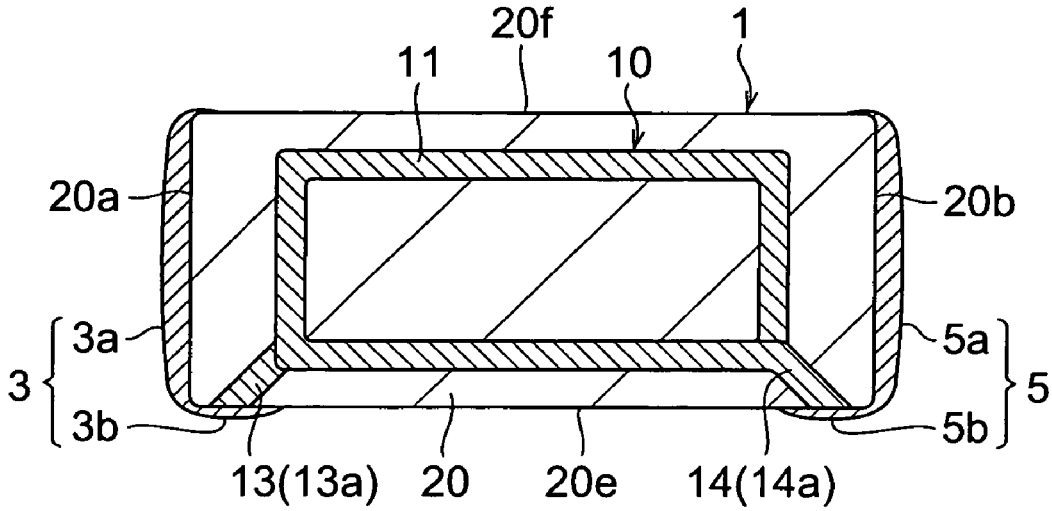
Figure 15:
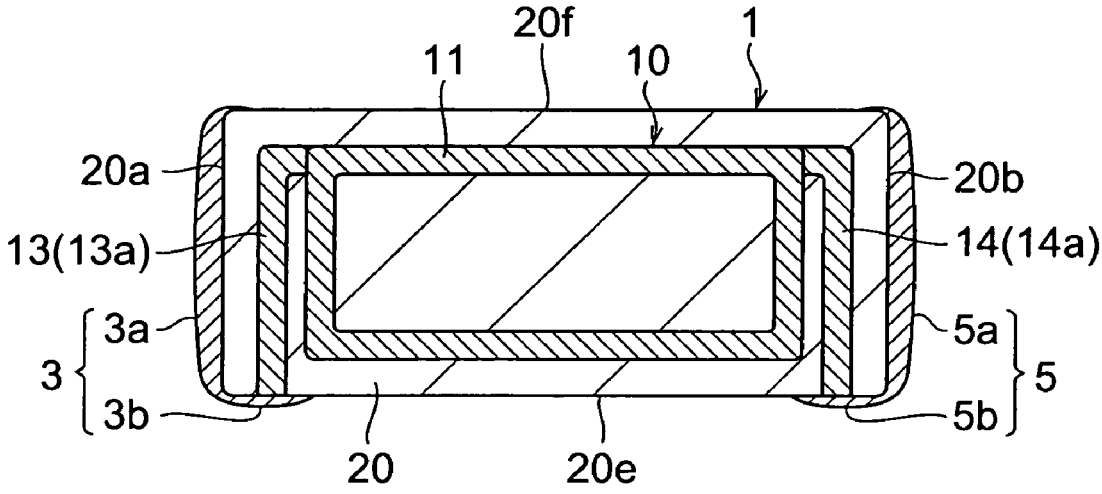
Figure 16:
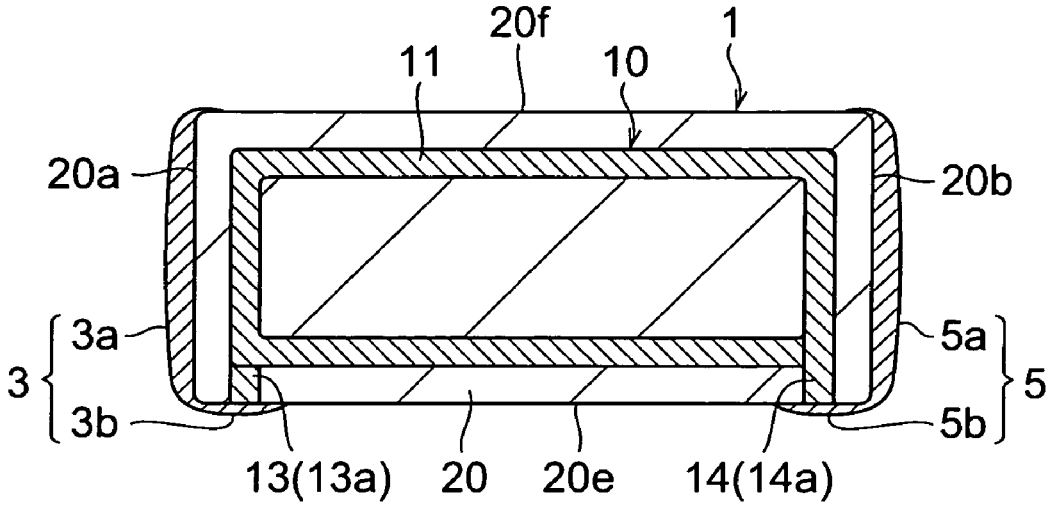

As shown in FIGS. 14 to 16, the lead conductors 13, 14 (conductor patterns 13*a*, 14*a*) may be connected to the second electrode portions 3*b*, 5*b*. In these configurations, the lead conductors 13, 14 (conductor patterns 13*a*, 14*a*) extend toward the third side face 20*e*.

The inductance of the multilayer inductors L1, L2 can be adjusted by the width of the coiled conductor 11 (conductor patterns 11*a*–11*d*), the number of layers, etc., and is not limited to that in the above-described embodiments.

In the first and second embodiments the element 1 was made by the green sheet lamination method of laminating green sheets, but, without having to be limited to it, the element 1 may be made by a printing lamination method. In the printing lamination method the element 1 is made by using a nonmagnetic slurry and printing the nonmagnetic slurry, the conductor patterns 11*a*–11*d*, 13*a*, 14*a*, etc. to form a laminate.

The first and second embodiments were the application of the present invention to the multilayer inductors, but the present invention may also be applied to coil components of a winding type, without having to be limited to the multilayer inductors.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A coil component comprising:

a coil part including a coiled conductor, and lead conductors located at both ends of the coiled conductor and having a width identical to a width of the coiled conductor;

an outer sheath part covering the coil part and having an electrical isolation; and a plurality of external electrodes electrically connected to the respective lead conductors, wherein the outer sheath part has two first side faces which are parallel to an axial direction of the coiled conductor and which are not adjacent to each other, and two second side faces intersecting with the axial direction of the coiled conductor and a fourth side face, and wherein each of the external electrodes has an electrode portion formed so as to extend throughout a direction perpendicular to the axial direction of the coiled conductor on the first side face and is not substantially formed on the second side faces and the fourth side face.

2. The coil component according to claim 1, wherein the outer sheath part further has a third side face parallel to the axial direction of the coiled conductor and adjacent to each first side face, and wherein each of the external electrodes further has an electrode portion which is formed on a part of the third side face and which is electrically continuous to the electrode portion formed on the first side face.

3. The coil component according to claim 2, wherein each of the lead conductors extends toward the third side face and is connected to the electrode portion formed on the third side face, thereby being electrically connected to the corresponding external electrode.

4. The coil component according to claim 2, wherein the fourth side face is parallel to the axial direction of the coiled conductor and adjacent to each first side face and is located so as to face the third side face with the coil part in between, and wherein each of the external electrodes further has an electrode portion which is formed on a part of the fourth side face and which is electrically continuous to the electrode portion formed on the first side face.

5. The coil component according to claim 4, wherein each of the lead conductors extends toward the third side face and is connected to the electrode portion formed on the third side face, thereby being electrically connected to the corresponding external electrode.

6. The coil component according to claim 1, wherein each of the lead conductors extends toward the first side face and is connected to the electrode portion formed on the first side face, thereby being electrically connected to the corresponding external electrode.

7. The coil component according to claim 6, wherein the outer sheath part further has a third side face, and the third and fourth side faces are parallel to the axial direction of the coiled conductor and adjacent to each first side face and are located so as to face each other with the coil part in between, and wherein, where the third side face is defined as a mounting surface, when viewed from the axial direction of the coiled conductor, a spacing between each lead conductor and the fourth side face is set smaller than a spacing between each lead conductor and the third side face.

8. The coil component according to claim 1, wherein the outer sheath part includes a plurality of stacked insulators, and wherein the coiled conductor and the lead conductors are comprised of conductor patterns formed on the respective insulators.

* * * * *